United States Patent [19]

Minegishi et al.

[11] 4,174,265

[45] Nov. 13, 1979

[54] BLACK CHROMIUM ELECTROPLATING PROCESS

[76] Inventors: Tomoya Minegishi, 4-9, 5-chome, Yachiyodai Kita, Yachiyo-shi, Chiba-ken; Matsufumi Takaya, 663-88 Usuita, Sakura-shi, Chiba-ken, both of Japan

[21] Appl. No.: 827,963

[22] Filed: Aug. 26, 1977

Related U.S. Application Data

[63] Continuation of Ser. No. 631,178, Nov. 11, 1975, abandoned.

[51] Int. Cl.[2] ..... C25D 3/04

[52] U.S. Cl. ..... 204/51

[58] Field of Search ..... 204/51, 1 R, 1.5

[56] References Cited

U.S. PATENT DOCUMENTS

| | | | |
|---|---|---|---|
| 3,311,548 | 3/1967 | Brown et al. | 204/51 |
| 3,909,404 | 9/1975 | Boycott | 204/51 |

FOREIGN PATENT DOCUMENTS

| | | | |
|---|---|---|---|
| 624887 | 8/1961 | Canada | 204/51 |

*Primary Examiner*—Donald L. Walton
*Attorney, Agent, or Firm*—Carroll F. Palmer

[57] ABSTRACT

A conductive body as a cathode is electroplated with chromium in the presence of radioactive rays in a plating bath comprising an aqueous solution of chromium trioxide.

3 Claims, No Drawings

BLACK CHROMIUM ELECTROPLATING PROCESS

This is a continuation of application Ser. No. 631,178, filed Nov. 11, 1975 now abandoned.

BACKGROUND OF THE INVENTION

I. Field of the Invention

This invention relates to a chromium plating process and more particularly to a process for electroplating a conductive body such as a metal piece with a highly adherent black chromium coating.

II. Description of Prior Art

A prior art black chromium electroplating process uses a plating bath of an aqueous solution of chromium trioxide containing radical ions-producing substances such as glacial acetic acid and sulfuric acid. In the bath a conductive body serving as a cathode is plated by electrodeposition with a black chromium coating. But the plating bath is very unstable and its composition widely varies during plating. It is therefore difficult to obtain a product having a chromium coating of stable quality. In addition, the prior art process using the above-mentioned bath requires a current density as high as 100 to 200 A/dm$^2$. Further, the plating ability of the bath is rapidly lowered, and the bath comes to have a short pot life.

Attempts have been made to render the bath stable and the pot life long by adding to the bath additives such as fluorine compounds, silicofluoric acids or derivatives thereof, sulfates or the like. However, since the content of these additives and a temperature of the bath must be strictly controlled in plating in order to obtain a uniform, black chromium coating, the bath cannot be and is not practically employed.

SUMMARY OF THE INVENTION

It is an object of the invention to provide a black chromium plating process which can form a black chromium coating of good quality entirely on an object in a simple manner.

Another object of the invention is to provide a black chromium electroplating process which can be performed at a relatively low current density.

Still another object of the invention is to provide a black chromium electroplating process which can be performed almost regardless of the composition of a plating bath used.

These and other objects which will be apparent from the following detailed description are attained by a process which comprises immersing an anode and a cathode of electrically conductive material in a plating bath comprising an aqueous solution of chromium trioxide, and passing a D.C. current between the cathode and the anode to plate the cathode with a chromium coating, wherein the improvement comprises the presence of radioactive rays during plating.

This invention is based on the discovery that the additives as ordinarily used in prior art baths mainly contribute to activation of chromium ions present in the bath and that the activation of said ions can be achieved by radioactive rays.

DETAILED DESCRIPTION OF THE PREFERRED EMBODIMENTS

The plating bath used in the process according to this invention generally comprises 70 to 1000 g, preferably 250 to 600 g, of chromium trioxide dissolved per liter of water. The plating bath may contain additives customarily used in a prior art bath such as water soluble salts of alkali or alkaline earth metals, inorganic acids and organic acids. Among such salts are carbonates, nitrates or chlorides of sodium, lithium, calcium or barium. The inorganic acids include sulfuric acid, hydrohalogenic acid, phosphoric acid and the like, and the organic acids include acetic acid, oxalic acid, formic acid and the like. These additives may be contained, if desired, in the plating bath in an amount ranging from 0.1 to 10 g per liter of water.

As previously mentioned, in accordance with this invention the chromium plating is conducted in the presence of radioactive rays. It should be noted that the invention resides in the existence of radioactive rays during plating and that the invention should not be limited to the way how such rays come to exist during plating. Radioactive rays issuing from an appropriate radiation source which is disposed outside the plating bath may be applied to the bath, or radioactive rays can be present in the bath because they emit from a radiation emitting substance contained in the bath. Alternatively, the plating bath may contain a substance which can emit radioactive rays when excited by activation rays and activation rays are applied to the substance so that the substance may emit radioactive rays therefrom.

There are many radiation sources well known in the art, including electron accelerators, X-ray generators, and radioactive isotopes such as cobalt 60, cesium 137 and strontium 90. The dose of radioactive rays issuing from radiation source may be 1.5 to 20 $\mu$rad.

Notable among radiation emitting substances are actinide compounds such as, for example, hydroxides, halides, nitrates and acetates of thorium or uranium. A mixture of these compounds can be used. These radiation emitting substances are contained in an amount of $7\times10^{-2}$ to $7\times10^{-1}$ $\mu$Ci per 100 grams of chromium trioxide.

Substances which can emit radioactive rays when excited by activation rays are those having radioisotopes as their isotopes, including strontium, cobalt, cesium and the like. A mixture of these substances can also be used. As noted above, these substances by themselves emit radioactive rays when they are excited by activation rays, and it is therefore unnecessary to irradiate activation rays thereafter.

According to this invention the plating effect relies on ions (chromium ions, radical ions of additives) activated by radioactive rays rather than concentrations of chromium trioxide or additives present in the plating bath. Therefore, the composition of the plating bath such as concentrations of chromium trioxide and additives used in the invention can be widely varied, facilitating the preparation of the bath. The dose of radioactive rays should be good enough to activate ions contributing to the chromium plating so as to obtain a chromium coating of desired quality.

The black chromium plating of the invention can be performed in a prevailing manner, provided radioactive rays are present during plating. An anode of lead, a lead alloy or the like and a cathode of electrically conductive material are immersed in a chromium plating bath, and a D.C. current is passed between the anode and the cathode. In a process of this invention the plating can be effected at a bath temperature of $-5°$ to 50° C., preferably 15° to 30° C., using a current density as low as 2 to 100 A/dm$^2$, preferably 20 to 100 A/dm$^2$.

This invention will be more fully understood from the following Examples.

EXAMPLE 1

A plating bath was prepared by dissolving in one liter of water 300 g of chromium trioxide, 7 g of thorium fluoride, 10 g of thorium nitrate and 0.6 g of barium carbonate. In the bath were immersed an anode of 5% Sn-Pb alloy and a cathode, i.e., a steel plate to be plated 30 mm long, 30 mm wide and 1 mm thick. A D.C. current was allowed to pass across the anode and the cathode at a current density of 50 A/dm$^2$ for five minutes while the bath was kept at 25° C. As a result, the steel plate was plated entirely with a uniform and real black chromium coating.

Control 1

Plating was performed for 30 minutes under the same conditions as in Example 1, but the plating bath was an aqueous solution comprising 300 g of chromium trioxide and 0.6 g of barium carbonate both dissolved per liter of water. The chromium coating on the plate was extremely nonuniform and gray-colored.

EXAMPLE 2

A plating bath was prepared by dissolving in one liter of water 300 g of chromium trioxide, 5 g of thorium nitrate, 1.5 g of thorium hydroxide and 0.6 g of barium carbonate. Plating was conducted under the same conditions as in Example 1, but the current density was 10 A/dm$^2$ and the bath temperature was 40° C. The steel plate was electroplated with a chromium coating having nearly the same quality as in Example 1.

EXAMPLE 3

Chromium trioxide (250 g), uranium acetate (5 g), uranium nitrate (5 g) and barium carbonate (0.5 g) were dissolved in one liter of water to obtain a plating bath. A 5% Sn-Pb alloy serving as anode and a 50×50 ×1 mm copper plate as cathode were dipped in the bath, and plating was effected for three minutes at a current density of 30 A/dm$^2$ while the bath was kept at 20° C. Thus, the copper plate was electroplated entirely with a uniform and real black chromium coating.

EXAMPLE 4

Chromium plating was continued for six months under the same conditions as in Example 1, but the current was introduced in an amount of 50 Ah per day. During plating, the amount of consumed chromium trioxide was measured by Baume hydrometer and was compensated to substantially keep the initial concentration of chromium trioxide in the bath, and no other additives were added. In the bath a uniform and real black chromium coating was continuously formed on the steel plate over the entire period of time.

Further, when the bath had been allowed to stand for three months, plating was performed under the same conditions as mentioned above, obtaining the steel plate having thereon a lustrous and real black chromium coating.

Control 2

Plating was conducted under the same conditions as in Example 4, but use was made of a commercially available plating bath consisting of 300 g of chromium trioxide, 7 g of barium acetate, 15 g of boric acid and 12 g of sodium nitrate dissolved per liter of water. The chromium coating plated on the steel plate became greyish in ten days, and a real black coating could not be produced any more. Therefore, the additives were added to the plating bath, but a real black chromium coating was not immediately formed on the entire steel plate.

The bath was allowed to stand for other three months, and then plating was performed under the same conditions, obtaining a greyish black and grained chromium coating on the plate.

EXAMPLE 5

It is well known in the art that a black chromium coating can not be produced from a plating bath consisting of chromium trioxide (300 g) and barium carbonate (0.6 g) dissolved per liter of water unless a low bath temperature and a high current density (more than 100 A/dm$^2$) are employed.

One liter of plating bath of the same composition as above was charged in a 100×100×150 mm parallelepiped tank of polyvinyl chloride covered with a lead plate 0.5 mm thick. An anode of 5% Sn-Pb alloy and a cathode, i.e., a 30×30×1 mm steel plate were immersed in the bath, and plating was effected at a current density of 50 A/dm$^2$ and at a bath temperature of 20° C. under irradiation of X-rays at a dose of 10 μrad/min. Thus, a uniform and real black chromium coating was produced entirely on the steel plate.

Further, the plating bath was allowed to stand for one day, and then the plating was conducted under the same conditions as above, immediately obtaining a uniform and real black chromium coating on the steel plate. When X-rays were not applied, however, only a yellowish chromium coating was obtained on the steel plate.

What we claim is:

1. A black chromium electroplating process comprising immersing an anode and a cathode of electrically conductive material to be plated in a plating bath comprising 70 to 1000 g of dissolved chromium trioxide per liter and a radioactive substance selected from the group consisting of a hydroxide, halide, nitrate or acetate of thorium or uranium in an amount of $7\times10^{-2}$ to $7\times10^{-1}$ μCi per 100 parts by weight of chromium trioxide contained in the bath and passing a D.C. current between the anode and the cathode to plate the cathode with a black chromium coating.

2. A black chromium electroplating process comprising immersing an anode and a cathode of electrically conductive material to be plated in a plating bath comprising an aqueous solution of chromium trioxide, adding to the bath at least one radioactive substance selected from the group consisting of hydroxides, halides, nitrates and acetates of thorium and uranium, passing a D.C. current between the cathode and the anode to plate the cathode with a chromium coating and activating hexavalent chromium ions present in said bath to cause the chromium coating resulting from said electroplating to be black by the radioactive emissions from said radioactive substance present in said bath.

3. A black chromium electroplating process comprising immersing an anode and a cathode of electrically conductive material to be plated in a plating bath comprising 70 to 1000 g. of dissolved chromium trioxide per liter, passing a DC current between the anode and the cathode and during plating applying to the plating bath radiation selected from the group consisting of x-rays, electron accelerator rays and radiations from cobalt 60, cesium 137 and strontium 90 emitted from a radiation source disposed outside said plating bath to provide a black chromium coating on said cathode, the dose of said group radiation being 1.5 to 20 μrad.

* * * * *